US009096089B2

(12) United States Patent
Tokumaru

(10) Patent No.: US 9,096,089 B2
(45) Date of Patent: Aug. 4, 2015

(54) APPARATUS, METHOD, AND IMAGE FORMING APPARATUS

(71) Applicant: CANON KABUSHIKI KAISHA, Tokyo (JP)

(72) Inventor: Akiko Tokumaru, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/170,189

(22) Filed: Jan. 31, 2014

(65) Prior Publication Data

US 2014/0224138 A1 Aug. 14, 2014

(30) Foreign Application Priority Data

Feb. 13, 2013 (JP) ..... 2013-025816

(51) Int. Cl.

| | |
|---|---|
| ***B44B 5/00*** | (2006.01) |
| ***B41K 3/36*** | (2006.01) |
| ***G03G 15/36*** | (2006.01) |
| ***B26F 1/00*** | (2006.01) |
| ***B26F 1/12*** | (2006.01) |
| ***B41J 11/66*** | (2006.01) |
| *B26D 5/32* | (2006.01) |
| *B26F 1/36* | (2006.01) |

(52) U.S. Cl.

CPC ..... *B41K 3/36* (2013.01); *B26F 1/0092* (2013.01); *B26F 1/12* (2013.01); *B41J 11/663* (2013.01); *G03G 15/36* (2013.01); *B26D 5/32* (2013.01); *B26F 1/36* (2013.01)

(58) Field of Classification Search

USPC ..... 101/26

See application file for complete search history.

(56) References Cited

U.S. PATENT DOCUMENTS

| | | | | | |
|---|---|---|---|---|---|
| 5,802,179 | A * | 9/1998 | Yamamoto | 380/51 |
| 5,825,947 | A * | 10/1998 | Sasaki et al. | 382/321 |
| 5,860,679 | A * | 1/1999 | Fukuda et al. | 283/70 |
| 5,896,403 | A * | 4/1999 | Nagasaki et al. | 714/752 |
| 7,922,099 | B1 * | 4/2011 | Schmidt et al. | 235/494 |
| 7,936,482 | B2 * | 5/2011 | Takezaki et al. | 358/3.28 |
| 7,938,330 | B2 * | 5/2011 | Kiuchi et al. | 235/454 |

FOREIGN PATENT DOCUMENTS

| | | |
|---|---|---|
| JP | 2003-076959 | 3/2003 |
| JP | 2009-087306 | 4/2009 |

* cited by examiner

*Primary Examiner* — Anthony Nguyen

(74) *Attorney, Agent, or Firm* — Fitzpatrick, Cella, Harper & Scinto

(57) ABSTRACT

To make it possible to easily and accurately form a cutout indicative of the presence of a code in printed matter. An apparatus according to the present invention includes a unit configured to determine a position of attachment of a code including voice information in an image and an attaching unit configured to attach a mark in a position based on the determined position of code attachment in the image, wherein the mark indicates a position to be cut out from a sheet, on a side of which the image and the attached mark are to be printed and a cutout caused by the cutting indicates a position of code attachment.

12 Claims, 18 Drawing Sheets

| FIG.3A | |
|---|---|
| FIG.3B | |

| FIG.8A | |
|---|---|
| FIG.8B | |

APPARATUS, METHOD, AND IMAGE FORMING APPARATUS

BACKGROUND OF THE INVENTION

1. Field of the Invention

The present invention relates to an image forming apparatus capable of handling a code and a control method thereof.

2. Description of the Related Art

For example, it is possible for a two-dimensional code to include a by far larger amount of information per printed area compared to a general character string having the same printed area, and therefore, the two-dimensional code begins to be used widely also as information transmission means in a variety of fields. In recent years, for example, it is put to practical use to optically read a QR code (registered trademark) printed on printed matter by a camera of a mobile telephone etc., to decode the code, and to read the coded character string aloud. It can be said that the reading aloud technology of decoded results such as this is a convenient technology for the visually impaired.

However, it is difficult for the visually impaired to accurately grasp which part of the printed matter a code is included in and besides that, it is difficult to know even the fact itself that a code is included in the printed matter.

To solve the former problem, the apparatus that enables accurate reading of a two-dimensional code printed on printed matter by a comparatively simple operation has been proposed (see Japanese Patent Laid-Open No. 2009-087306).

To solve the latter problem, it has been stipulated that a cutout be formed in printed matter to which a code is attached so that it is possible for the visually impaired to immediately recognize that a code is attached to the printed matter in the field of the two-dimensional code called, for example, a voice code. It has been also stipulated that a voice code be printed without exception in the bottom-right corner of a document and a cutout be also provided without exception in the vicinity thereof, thereby allowing the presence and the position of the voice code to be grasped by the cutout (with regard to the voice code, see Japanese Patent Laid-Open No. 2003-076959).

As described above, for the voice code, for example, there is a rule to print a voice code in a specified position of printed matter on which a code is printed and to form a cutout indicative of the presence of the voice code in the vicinity thereof. Because of this, a cutout is formed manually in printed matter after printing by a dedicated tool or printing is performed using a sheet provided with a cutout in advance.

In these circumstances, for example, in the case where a cutout is formed manually, such a problem may arise that a voice code cannot be read correctly because of formation of the cutout in an erroneous position.

Further, in the case of the voice code, the number of cutouts to be formed differs depending on whether the voice code is printed on both sides or only on one side of printed matter, and therefore, it is necessary to check each time how the voice code is printed at the time of forming a cutout. This is a task that requires a very large amount of effort and time.

Such a problem may commonly occur in the case where there is a similar rule for a code other than the voice code.

SUMMARY OF THE INVENTION

The apparatus according to the present invention includes a unit configured to determine a position of attachment of a code including voice information in an image and an attaching unit configured to attach a mark in a position based on the determined position of code attachment in the image, wherein the mark indicates a position to be cut out from a sheet, on a side of which the image and the attached mark are to be printed and a cutout caused by the cutting indicates a position of code attachment.

According to the present invention, it is possible for a user to accurately form a cutout indicative of the presence etc. of a code printed on printed matter with less effort and time in the printed matter.

Further features of the present invention will become apparent from the following description of exemplary embodiments (with reference to the attached drawings).

DESCRIPTION OF THE EMBODIMENTS

In each embodiment below, the case of the voice code and the QR code is explained as an example. However, the application scope of the present invention is not limited thereto and other kinds of codes, for example, barcode, dot code, glyph code, LVBC, and digital watermark can be applied to the present invention. Hereinafter, embodiments for embodying the present invention are explained in detail with reference to the accompanying drawings.

First Embodiment

Figure 1:
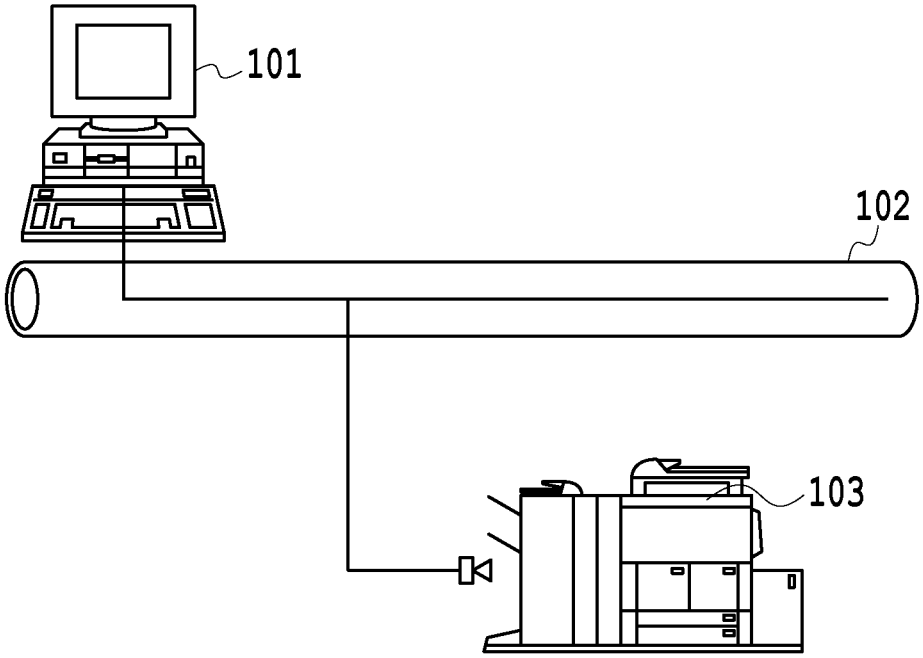
FIG. 1 is a diagram showing an example of a configuration of a printing system including an MFP as an image forming apparatus according to a first embodiment.

FIG. 1 is a diagram showing an example of a configuration of a printing system including a multi function peripheral (MFP) as an image forming apparatus capable of printing after attaching a code to a document image according to the present embodiment.

An MFP 103 is connected, together with a PC 101, to a LAN (Local Area Network) 102 using the Ethernet (registered trademark) etc.

The MFP 103 has a PDL (Page Description Language) function and a rendering function and is capable of receiving and printing PDL data specified by the PC 101 connected onto the LAN 102. It is also possible for the MFP 103 to save image data obtained by reading a document by a scanner function and PDL data received from the PC 101 in a specified area within an HDD. Further, it is possible for the MFP 103 to print raster image data saved in the specified area within the HDD.

It is possible for the PC 101 to transmit data of a document image of one or more pages via the LAN 102 to the MFP 103 as a printing command given via a printer driver. The PC 101 performs various kinds of data processing by a CPU (not shown) within the PC 101, executing an OS and various kinds of application programs and by executing applications under the management of the OS.

<Hardware Configuration of Image Forming Apparatus>

Figure 2:
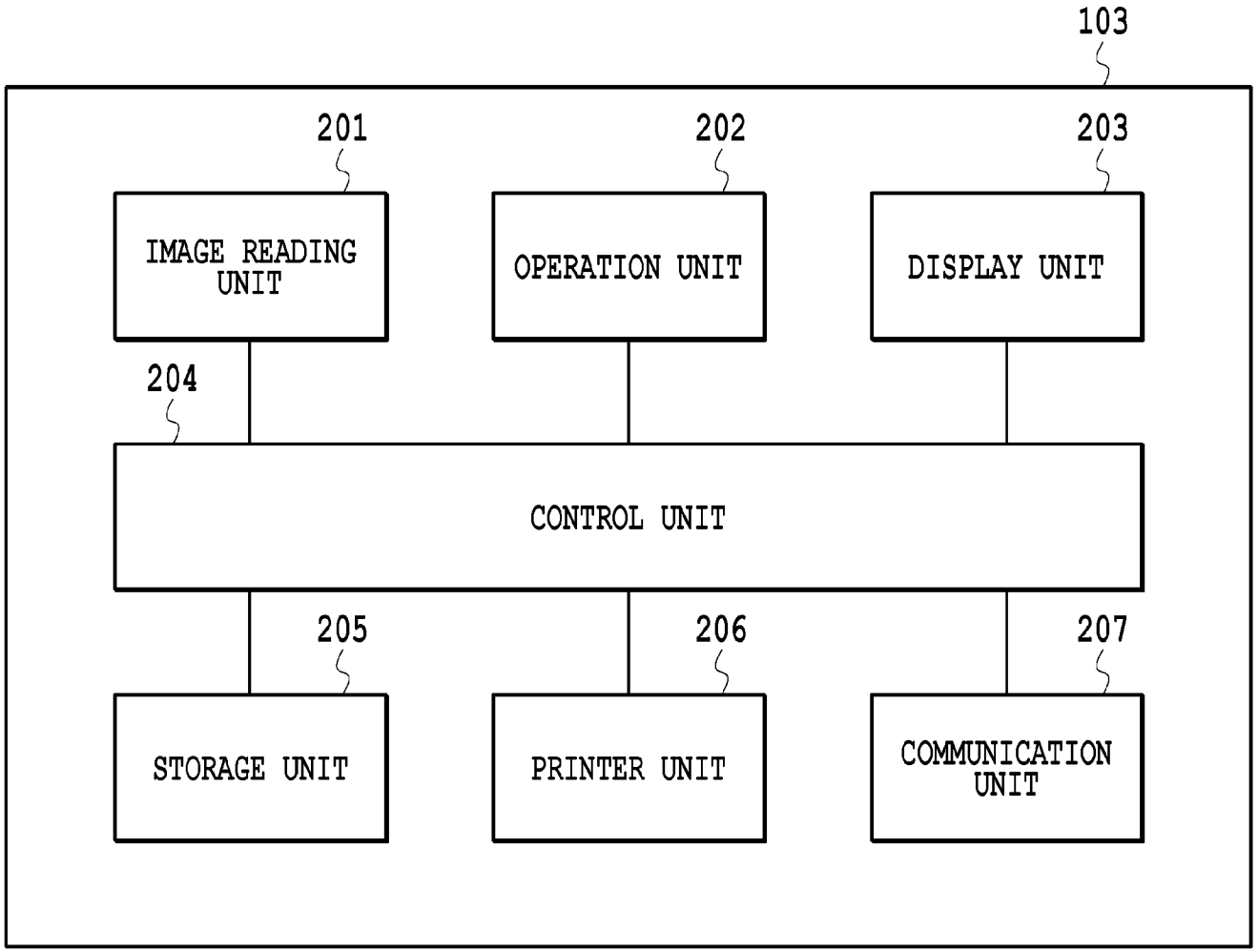
FIG. 2 is a block diagram showing a hardware configuration of the MFP.

FIG. 2 is a block diagram showing a hardware configuration of the MFP 103.

The MFP 103 includes an image reading unit 201, an operation unit 202, a display unit 203, a control unit 204, a storage unit 205, a printer unit 206, and a communication unit 207.

The control unit 204 mainly controls the whole of the MFP 103. Specifically, a CPU (not shown), reads control programs stored in a ROM of the storage unit 205 and executes the programs, thereby performing various kinds of control processing, such as reading control and transmission/reception control. Further, the control unit 204 is electrically connected with a plurality of processing units, such as the image reading unit 201, the printer unit 206, the operation unit 202, the display unit 203, the storage unit 205, and the communication unit 207 and performs control of these processing units. Furthermore, the control unit 204 develops PDL data received from the PC 101 via the LAN 102 into raster image data, transfers the developed raster image data to the storage unit 205 and the printer unit 206, and performs output control of the raster image data in the printer unit 206.

The storage unit 205 includes a ROM, a RAM, and an HDD and stores various programs and data. The ROM stores control programs etc. of the CPU and the RAM is a main memory of the CPU and used as a temporary storage area, such as a work area. The HDD stores programs, such as system software executed in the CPU, and is further used as a storage device configured to store image data and attribute data thereof, user data, etc.

The image reading unit 201 includes an image sensor for optically reading a document and converting it into an electric image signal, a reading drive unit, a light source lighting control unit, etc., and acquires image data of a document set on a document table etc. (not shown). Specifically, at the time of scan of the whole of the document by the image sensor driven by the reading drive unit, control is performed by the light source lighting control unit so that a light source, such as an LED within the image sensor, lights up. Further, the image sensor converts the read image data into an electric image signal. The electric signal converted in the image sensor is further converted into a brightness signal of each color of R, G, and B and the brightness signal is output to the control unit 204 as image data. The document is set on a document feeder and in response to instructions to start reading from the operation unit 202 by a user, instructions to read the document are given to the image reading unit 201 from the control unit 204. Upon receipt of instructions to read, the image reading unit 201 feeds the document one by one from the document feeder and performs the document reading operation. In place of the automatic feeding system by the document feeder, a method in which a document is placed on a glass surface and the document is scanned by moving an exposure unit may be accepted.

The printer unit 206 is an image forming device configured to form an image on a sheet in accordance with image data (print data) received from the control unit 204. The image forming system in the present embodiment is the electrophotographic system using a photoreceptor drum and a photoreceptor belt, however, the present invention is not limited to this system. For example, it is also possible to apply an inkjet system in which ink is ejected from a minute nozzle array for printing on a sheet.

The operation unit 202 is a user interface configured to receive various kinds of operations of a user.

The display unit 203 displays captured images and characters. In the display unit 106, for example, a liquid crystal display is used. It may also be possible for the display unit 106 to have a touch screen function and in such a case, user's instructions given via the touch screen can be acknowledged as inputs to the operation unit 202.

The communication unit 207 controls communication with an external device via the LAN 102 by, for example, receiving various kinds of information, such as PDL data and commands sent from the PC 101.

Next, an explanation will be given with respect to processing to print a mark to form a cutout indicative of the presence of a code in the vicinity of the code according to the present embodiment.

<In Case of Voice Code>

Figures 3, 3A:
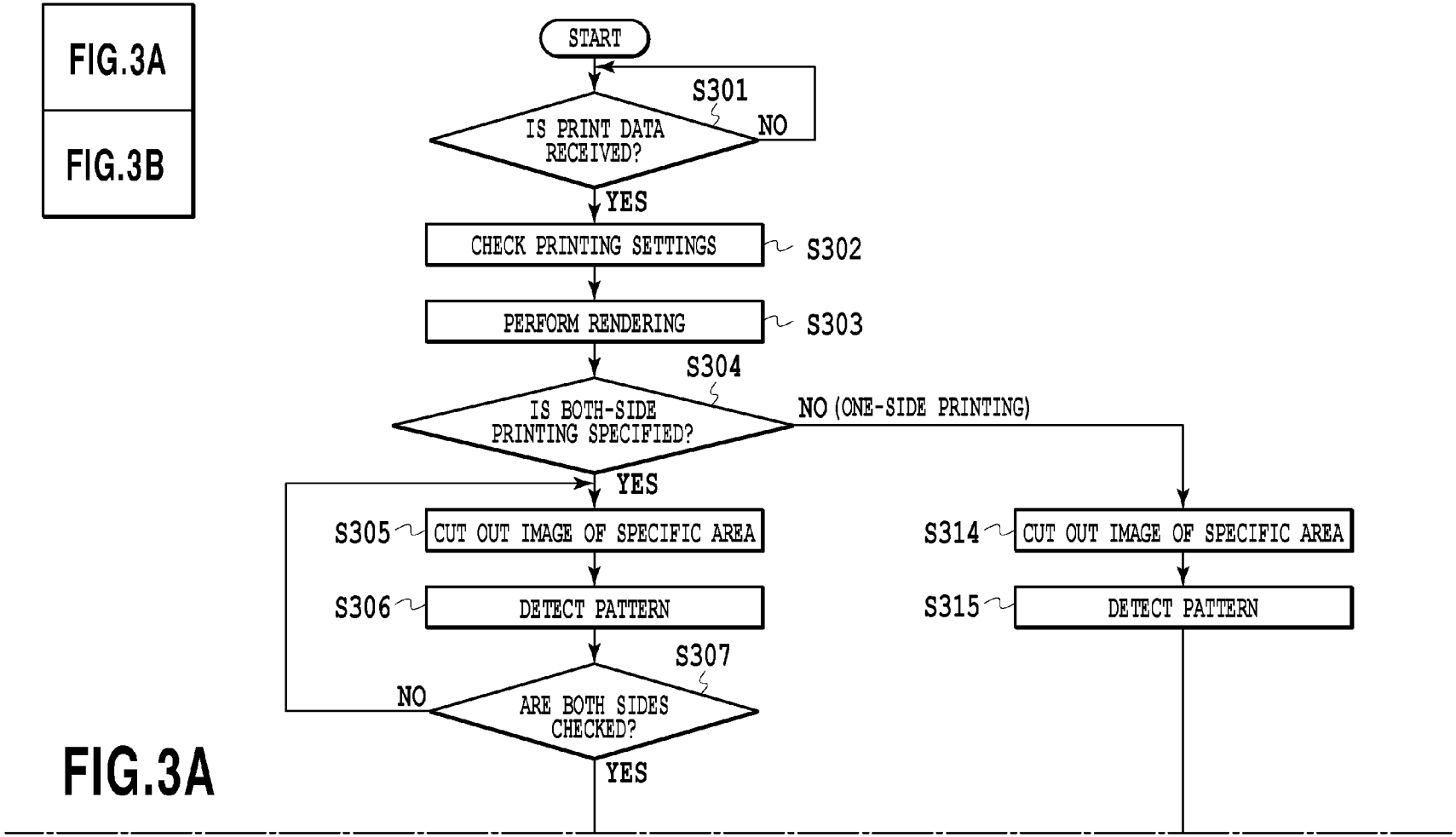
FIG. 3 is a diagram showing a relationship between FIGS. 3A and 3B, and FIGS. 3A and 3B are flowcharts showing a flow of printing processing in the case where a code attached to a document image is a voice code.
Figure 3B:
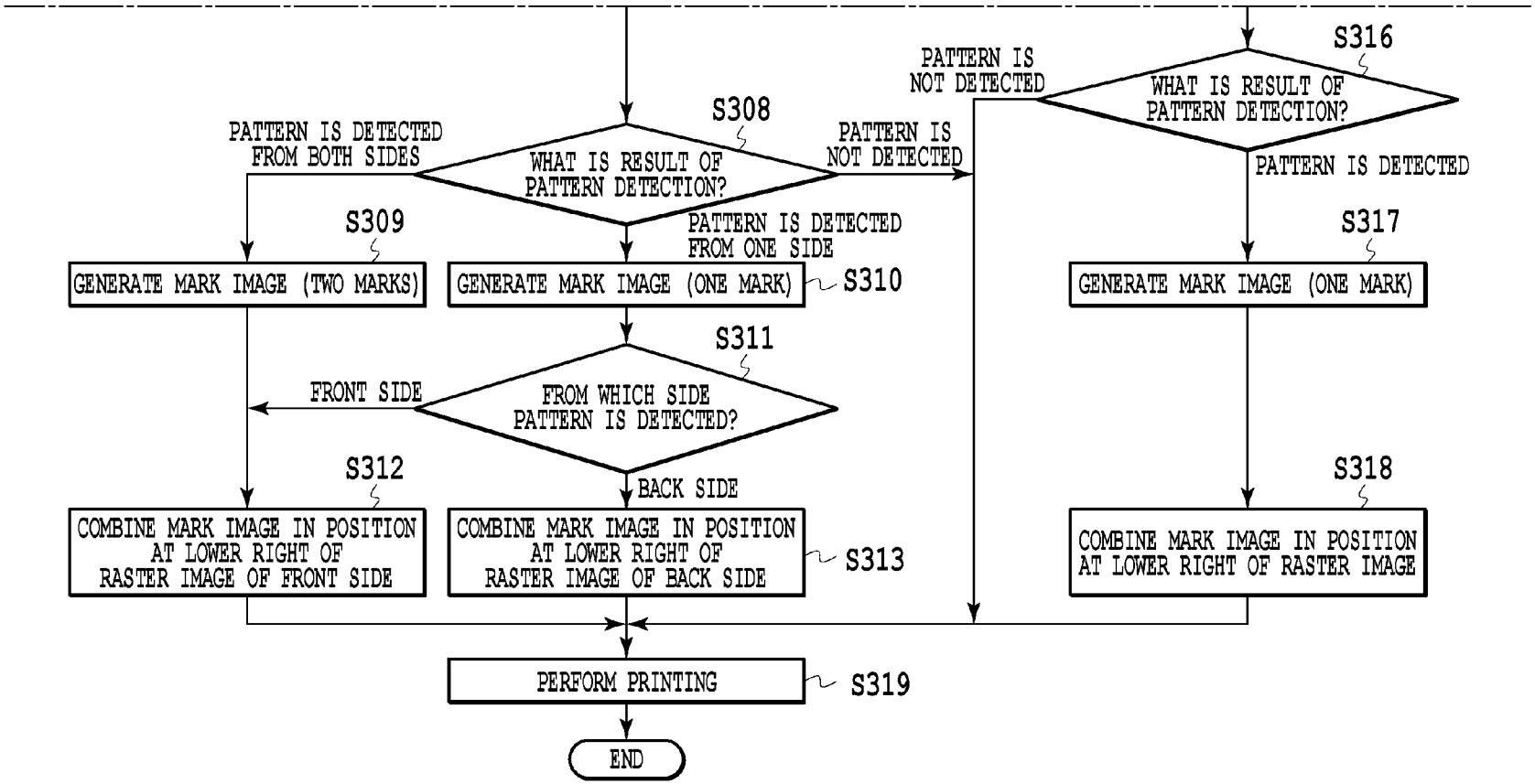

FIG. 3 is a flowchart showing a flow of printing processing in the present embodiment in the case where a code attached to a document image is a voice code including only voice data. The series of processing is performed by the CPU executing a computer executable program in which a procedure shown below is described after reading the program from the ROM onto the RAM.

At step 301, the control unit 204 determines whether the communication unit 207 receives the PDL data (print data) to be printed sent from the PC 101 via the LAN 102. In the case where the PDL is received, the procedure proceeds to step 302. The received PDL data is stored in the HDD.

At step 302, the control unit 204 checks the setting contents of the printing settings received at the communication unit 207 via the LAN 102. Here, the printing settings refer to settings relating to the printing conditions received at the same time as the reception of the PDL data from the PC 101 via the LAN 102 or specified in advance by a user operating the operation unit 202. In detail, the printing settings include the monochrome/color setting, the one-side/both-side printing setting, the Nup printing setting, etc. Among these, the contents of the one-side/both-side printing setting relate to how a mark is printed. The contents of the printing settings checked at this step are associated with the PDL data stored at step 301 and stored in the HDD.

At step 303, the control unit 204 performs rendering. Specifically, the PDL data stored in the HDD at step 301 is analyzed and developed into raster image data, such as bit map data. The developed raster image data is stored in a first specified area of the HDD.

At step 304, the control unit 204 determines whether both-side printing is specified in the printing settings checked at step 302. In the case where it is determined that the both-side printing is specified, the procedure proceeds to step 305. On the other hand, in the case where it is determined that the both-sided printing setting is not specified, the procedure proceeds to step 314.

First, each piece of processing at step 305 to step 313 in the case where it is specified that both-side printing is specified is explained.

At step 305, the control unit 204 acquires raster image data corresponding to one page from the first specified area of the HDD and cuts out a specific area determined in advance from the raster image. This specific area is set in advance by a user.

Figure 4:
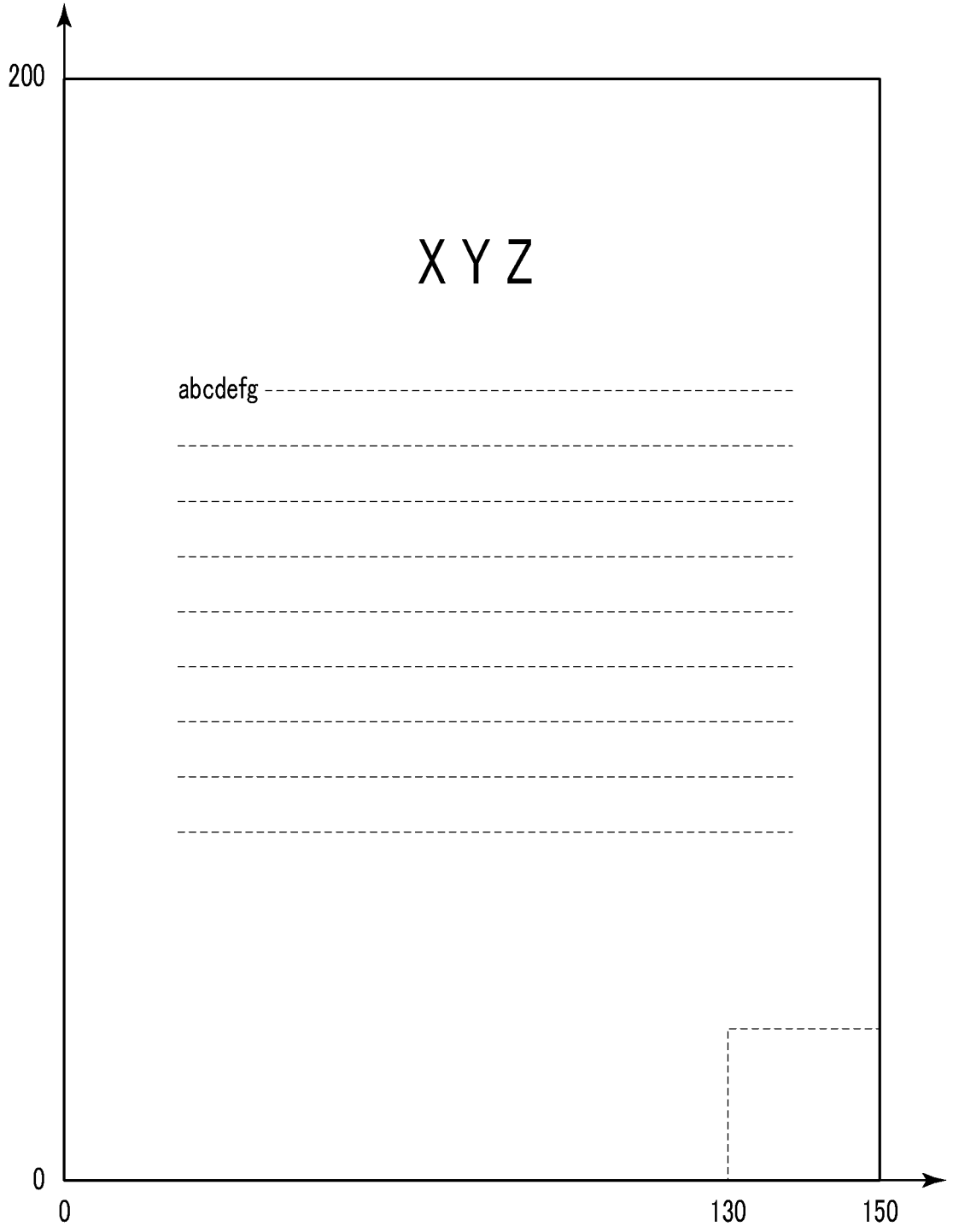
FIG. 4 is a diagram showing an example of a specific area.

FIG. 4 is a diagram showing an example of a specific area cut out in the case where the target code is a voice code. There is a rule that the bottom-right corner should be taken to be a reference point with respect to the correct orientation of a document in the case where a voice code is attached, and in the case where a plurality of voice codes is further attached to the same page, the voice codes should be arranged in the clockwise direction, and therefore, here, the specific area is set in the bottom-right corner of the page. In the example in FIG. 4, the area surrounded by coordinates (in the example in FIG. 4, (130, 0), (150, 0), (130, 20), (150, 20) with the bottom-left vertex as the origin (0, 0)) of vertexes of a portion surrounded by the dotted line is set.

The partial image corresponding to the specific area set in advance in this manner (hereinafter, referred to as a "specific area image") is cut out from the raster image data. The specific area image to be cut out differs depending on the kind of a code to be attached and it is needless to say that a specific area in accordance with a code is set appropriately. The data of the cut-out specific area image is stored in a second specified area of the HDD.

Figure 5A:
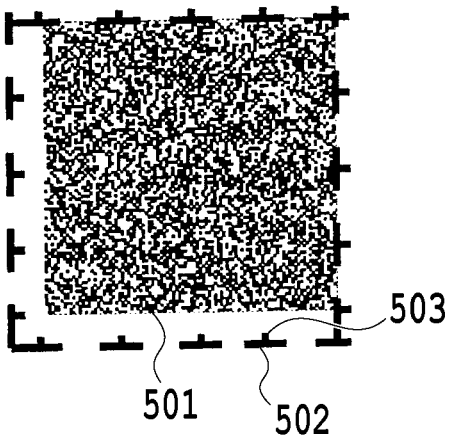
FIG. 5A is a diagram showing an example of a voice code and FIG. 5B is a diagram showing an example of a QR code.

At step 306, the control unit 204 performs processing to detect a predetermined pattern on the specific area image (raster image) cut out at step 305. Here, the predetermined pattern is a pattern registered in advance for detecting whether or not a code exists (including its position and direction). FIG. 5A is a diagram showing an example of a voice code. In the case of the voice code such as this, a pattern in which guide lines 503 are attached onto a broken line 502 surrounding the periphery of a data area 501 is registered as a pattern for detecting the voice code.

At step 307, the control unit 204 determines whether the processing at steps 305 and 306 is performed on the front side and the back side, i.e. both sides of a page in printed matter to be output. In the case where the processing at steps 305 and 306 is performed on both sides, the procedure proceeds to step 308. On the other hand, in the case where the processing at steps 305 and 306 is not performed on both sides, the procedure returns to step 305 in order to perform the processing on the outstanding page (back side). Then, the control unit 204 acquires the raster image data of the next page (back side) from the HDD and repeats the processing at step 305 and subsequent steps.

At step 308, the control unit 204 determines whether the predetermined pattern is detected as a result of the pattern detection processing at step 306 (in the case where the predetermined pattern is detected, whether the pattern is detected form both sides or from only one side is determined). In the case where the predetermined pattern is detected from both sides, the procedure proceeds to step 309. In the case where the predetermined pattern is detected only from one side, the procedure proceeds to step 310. In the case where the predetermined pattern is not detected, the procedure proceeds to step 319.

Figure 6A:
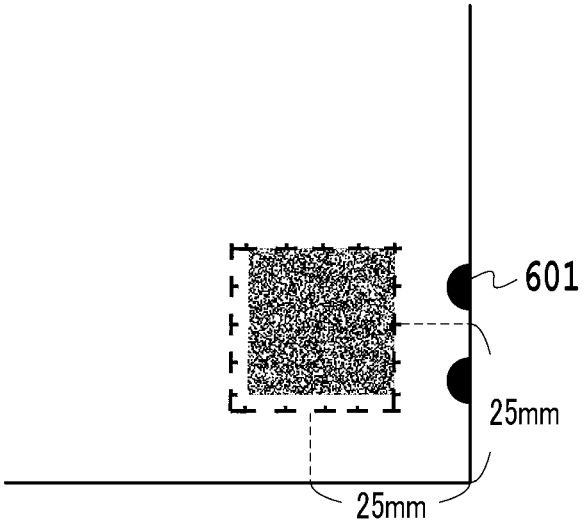
FIG. 6A is a diagram showing cutouts formed in printed matter and FIG. 6B is a diagram showing marks corresponding to the cutouts.
Figure 6B:
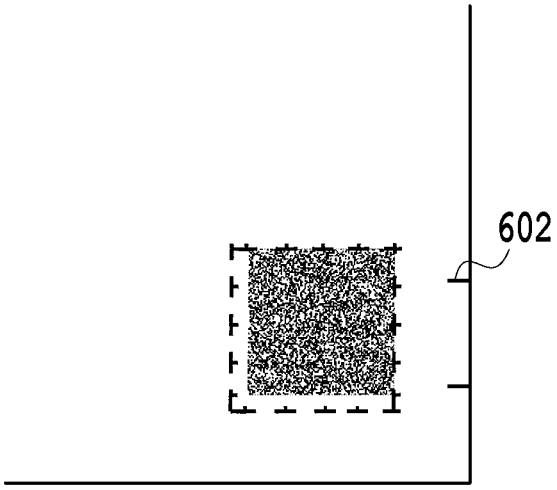

At step 309, the control unit 204 generates an image of a mark indicative of the position and the number of cutouts to be formed in an output sheet (printed matter) in the case where a voice code is attached to both sides of the output sheet. In the case where the voice code is attached to (printed on) both sides, there is a rule that two cutouts in the shape of a semicircle should be formed in positions at the lower right of the surface in the case where the printed matter is viewed in the correct orientation (at the lower left of the back side). Further, there is a rule that the voice code itself should be arranged so that the center position thereof is located 25 mm from the ends of the printed matter, and therefore, normally the cutout is formed to the right (in the case of the front side) thereof as a result. In the present embodiment, images of two segments extending vertically from the side in which the cutout is formed and connecting the center of each semicircle and the outer edge are generated as mark images. FIG. 6A shows two cutouts 601 formed in the printed matter and FIG. 6B shows marks 602 corresponding to each cutout.

Figure 7A:
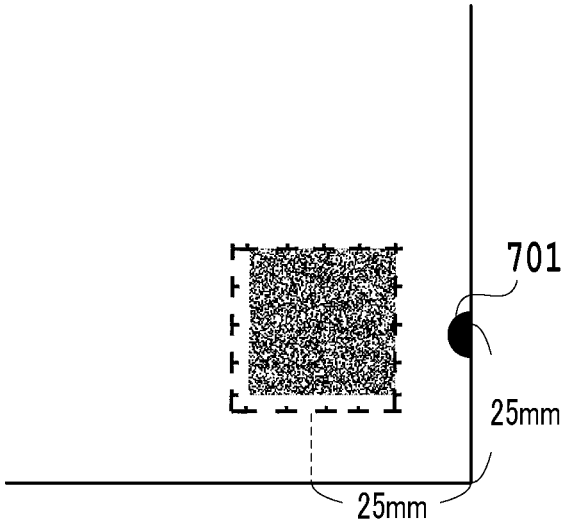
FIG. 7A is a diagram showing a cutout formed in printed matter and FIG. 7B is a diagram showing a mark corresponding to the cutout.
Figure 7B:
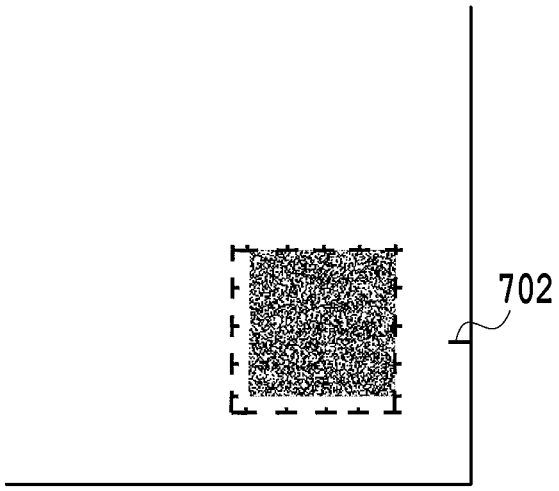

At step 310, the control unit 204 generates an image of a mark indicative of the position and the number of cutouts to be formed in an output sheet (printed matter) in the case where the voice code is attached to one side of the output sheet. In the case where the voice code is attached to (printed on) only one side, there is a rule that one cutout in the shape of a semicircle should be formed in a position at the lower right of the front side in the case where the printed matter is viewed from the correct orientation (at the lower left of the back side). In the present embodiment, an image of one segment extending vertically from the side in which the cutout is formed and connecting the center of the semicircle and the outer edge is generated as a mark image. FIG. 7A shows one cutout 701 formed in printed matter and FIG. 7B shows a mark 702 corresponding to the cutout.

At step 311, the control unit 204 determines whether the detected voice code is detected from the raster image of the front side or from the raster image of the back side. In the case where the voice code is detected from the raster image of the front side, the procedure proceeds to step 312. On the other hand, in the case where the voice code is detected from the raster image of the back side, the procedure proceeds to step 313.

At step 312, the control unit 204 combines the generated mark image with a raster image to be printed on the front side of an output sheet. Specifically, in the case of the mark image generated at step 309 (in the case where the pattern is detected from both sides), the control unit 204 combines a mark image including two marks in a position at the lower right of the raster image of the front side (see the foregoing FIGS. 6A and 6B). In the case of the mark image generated at step 310 (in the case where the pattern is detected from only one side), the control unit 204 combines a mark image including one mark in a position at the lower part of the right side of the raster image of the front side (see the foregoing FIGS. 7A and 7B). The data of the raster image with which the mark image is combined is stored in the first specified area of the HDD.

At step 313, the control unit 204 combines the generated mark image with a raster image to be printed on the back side of an output sheet. Specifically, the control unit 204 combines the mark image generated at step 310 and including one mark in a position at the lower right of the raster image of the back side (see the foregoing FIG. 7). The data of the raster image with which the mark image is combined is stored in the first specified area of the HDD.

The above is the processing in the case where it is determined that both-side printing is specified at step 304.

Next, a description will be given with respect to each piece of processing at step 314 to step 318 in the case where it is determined that one-side printing is specified at step 304.

At step 314, the control unit 204 acquires raster image data corresponding to one page from the first specified area of the HDD and cuts out the image of the specific area determined in advance from the raster image as at step 305.

At step 315, similar to step 306, the control unit 204 performs processing to detect a predetermined pattern on the specific area image (raster image) cut out at step 314.

At step 316, similar to step 308, the control unit 204 determines whether a predetermined pattern is detected as a result of the pattern detection processing at step 315. In the case where the predetermined pattern is detected, the procedure proceeds to step 317. On the other hand, in the case where the predetermined pattern is not detected, the procedure proceeds to step 319.

At step 317, similar to step 310, the control unit 204 generates an image of a mark (i.e. a mark image including one mark) that serves as a guide to a cutout in the case where the voice code is attached to one side of the output sheet.

At step 318, the control unit 204 combines the generated mark image with the raster image. Specifically, the control unit 204 combines the mark image generated at step 317 in a position at the lower right of the raster image (see the foregoing FIGS. 7A and 7B). The data of the raster image with which the mark image is combined is stored in the first specified area of the HDD.

At step 319, the control unit 204 transfers the data of the raster image with which the mark image is combined to the printer unit 206 and instructs the printer unit 206 to perform the printing operation in accordance with the printing settings.

By the above processing, printed matter on which the mark is printed is output, the mark indicating the position where the cutout indicative of the presence of a voice code should be formed and the number of cutouts.

In the example described above, the shape of a mark is a segment connecting the center of a semicircle, which is the shape of the cutout, and the outer edge, however, the shape is not limited to this and, for example, the shape may be a semicircle the same as that of the cutout.

<In Case of QR Code>

In recent years, the QR code capable of incorporating voice data has also been used. Next, a description will be given with respect to printing processing in the case where a code attached to a document image is a QR code on the assumption that a rule similar to that for the voice code is applied.

Figures 8, 8A:
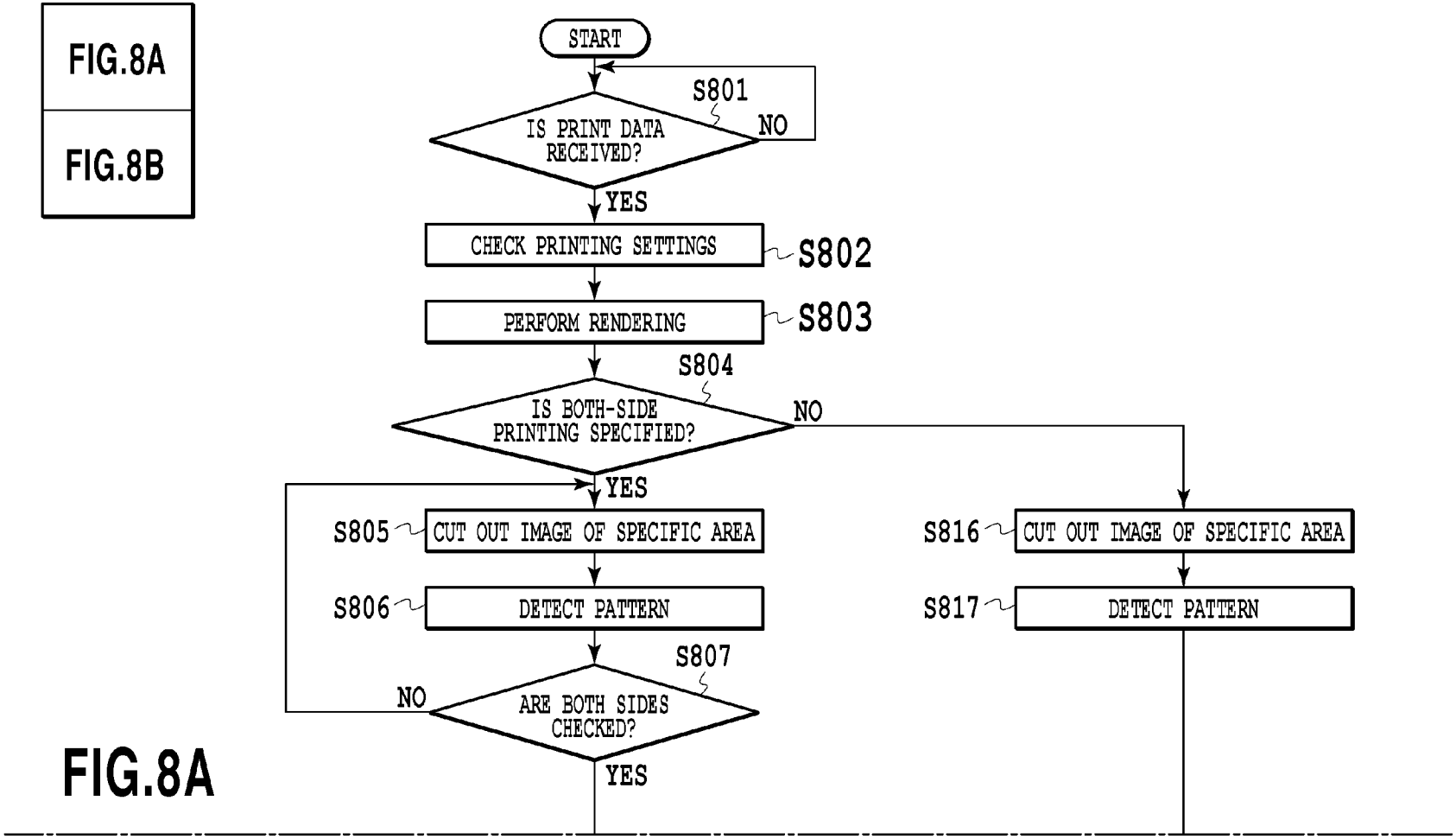
FIG. 8 is a diagram showing a relationship between FIGS. 8A and 8B, and FIGS. 8A and 8B are flowcharts showing a flow of printing processing in the case where a code attached to a document image is a QR code.
Figure 8B:
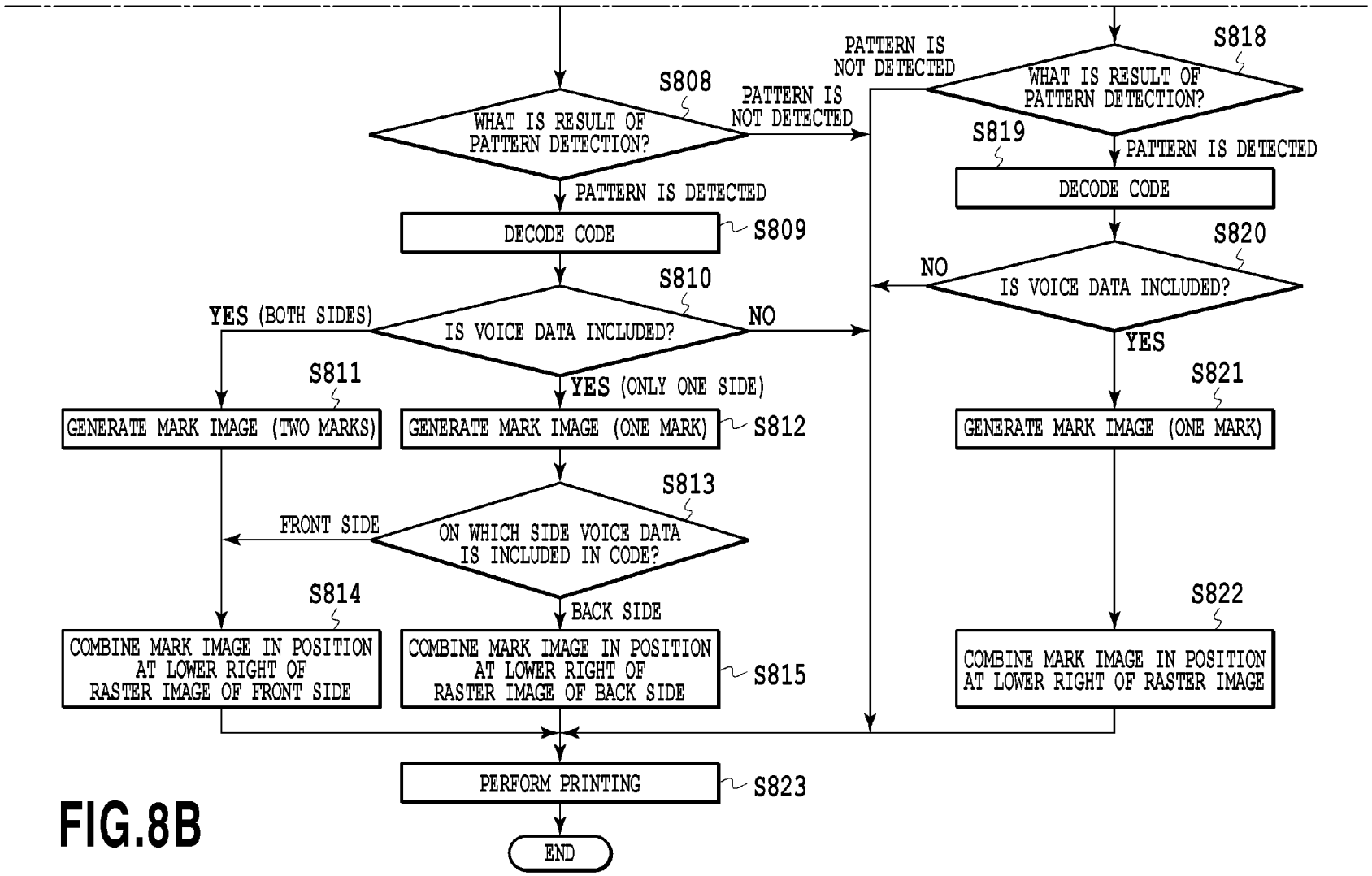

FIG. 8 is a flowchart showing a flow of printing processing in the case where a code attached to a document image is a QR code. In the following, points different from the voice code are explained mainly.

First, steps 801 to 803 correspond to the foregoing steps 301 to 303 and there is no difference in particular.

Figure 9:
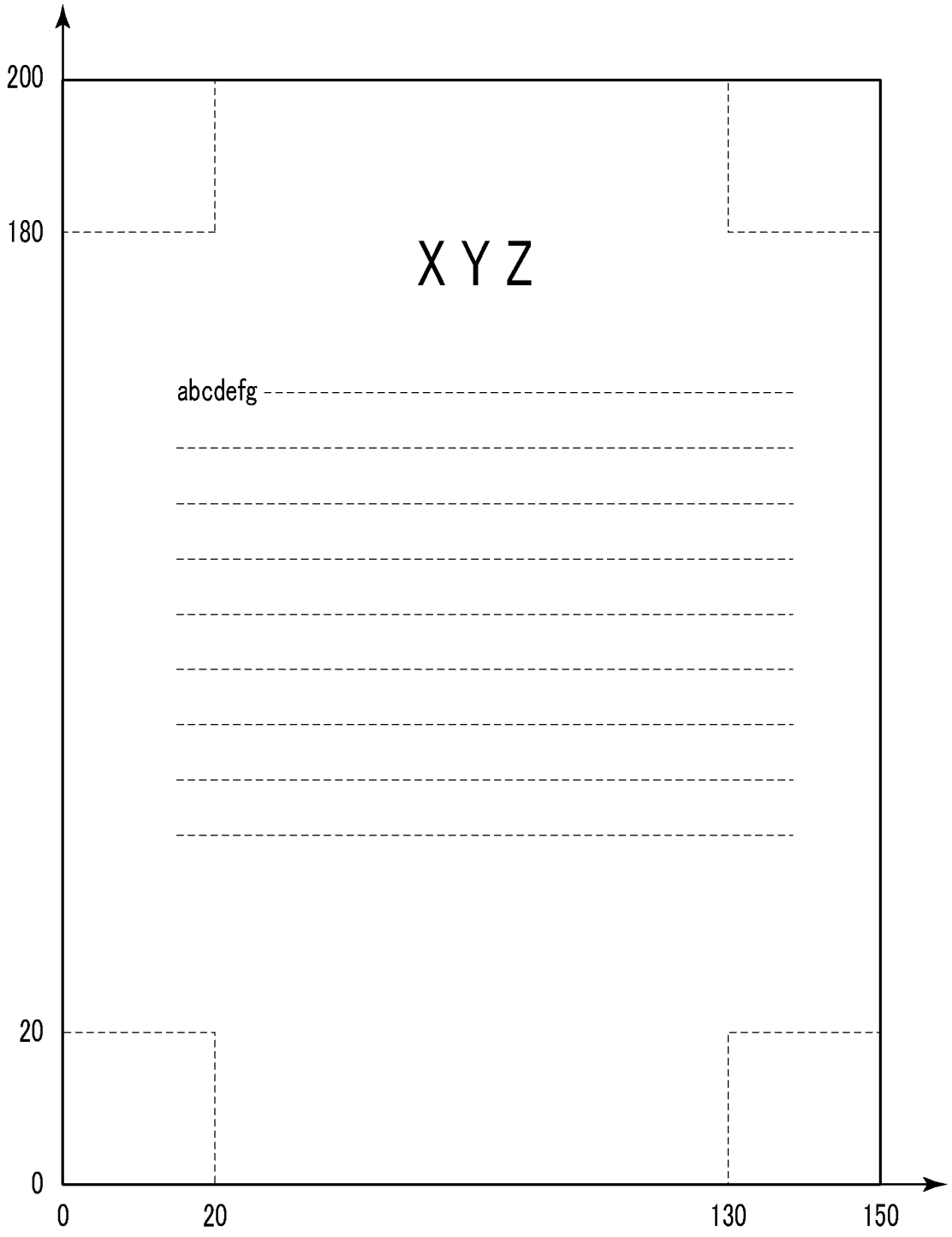
FIG. 9 is a diagram showing an example of a specific area.

At step 804, the control unit 204 acquires raster image data corresponding to one page from the first specified area of the HDD and cuts out a specific area determined in advance from the raster image. In a case where there exists a rule different from that for the voice code, a specific area in accordance with the rule is set as a result. FIG. 9 is a diagram corresponding to the foregoing FIG. 4 and is also a diagram showing an example of the specific area cut out at this step. Here, the specific area is set on the assumption that a QR code may be arranged in any of four corners of an image. As in FIG. 4, the bottom-left vertex is taken to be the origin and specific areas at four parts in total, i.e. the bottom-left corner, the top-left corner, the bottom-right corner, and the top-right corner are set and, for example, as the bottom-left corner, an area surrounded by (0, 0), (0, 20), (20, 0), and (20, 20) is set. Similarly, the areas in the top-left corner, in the top-right corner, and in the bottom-right corner are each set also by information of four vertexes. This specific area is also set in advance by a user and the data of the specific area image that is cut out is stored in the second specified area of the HDD.

Figure 5B:
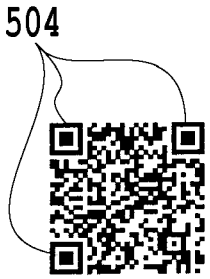

At step 806, the control unit 204 performs processing to detect a predetermined pattern on the specific area image (raster image) cut out at step 805. FIG. 5B is a diagram showing an example of a QR code. In the case of the QR code such as this, a finder pattern 504 arranged in the three corners (bottom-left corner, top-left corner, top-right corner) is registered as a predetermined pattern.

Step 807 is the same as step 307 and whether the processing at steps 805 and 806 is performed on the front side and the back side, i.e. on both sides of the page in the printed matter to be output is determined. In the case where the processing at steps 805 and 806 is performed on both sides, the procedure proceeds to step 808. On the other hand, in the case where the processing at steps 805 and 806 is not performed on both sides, the procedure returns to step 805 in order to perform the processing on the outstanding page (back side).

At step 808, the control unit 204 determines whether a finder pattern is detected in the pattern detection processing at step 806. In the case where a finder pattern is detected, the procedure proceeds to step 809. On the other hand, in the case where no finder pattern is detected, the procedure proceeds to step 823.

At step 809, the control unit 204 decodes the QR code included in the specific area image and analyzes information included in the QR code.

At step 810, the control unit 204 determines whether voice data is included in the information obtained by the analysis (in the case where voice data is included, determination is made as to whether voice data is included in the QR code on both sides or included only in the QR code on one side). In the case where voice data is included in the QR code on both sides, the procedure proceeds to step 811. In the case where voice data is included only in the QR code on one side, the procedure proceeds to step 812. In the case where voice data is not included in any QR code, the procedure proceeds to step 823.

Each piece of processing at step 811 and subsequent steps is the same as the processing at the step 309 and subsequent steps described previously except in that steps 819 and 820 are added, and therefore, explanation is omitted.

As explained above, according to the present embodiment, in the case where a voice code etc. is included in print data, a mark that serves as a guide at the time of forming a cutout indicative of the presence of a voice code etc. is printed. Due to this, it is possible for a user to form a cutout accurately in printed matter only by operating a dedicated tool in alignment with a printed mark.

Second Embodiment

In the first embodiment, a mark to form a cutout in printed matter to which a voice code etc. is attached is printed as it is in a position where the cutout should be formed. However, at the time of actual formation of a cutout by a user using a dedicated tool (hereinafter, referred to as a "punch") etc., there is a case where a cutout cannot be formed correctly in the position of the mark because the mark is hidden by the punch itself. In order to avoid this, an aspect is explained as a second embodiment, in which the printing position of a mark is adjusted by taking into consideration the shape of a punch used to form a cutout. The parts same as those in the first embodiment is simplified or omitted in the explanation and here, different points are explained mainly.

Figure 10:
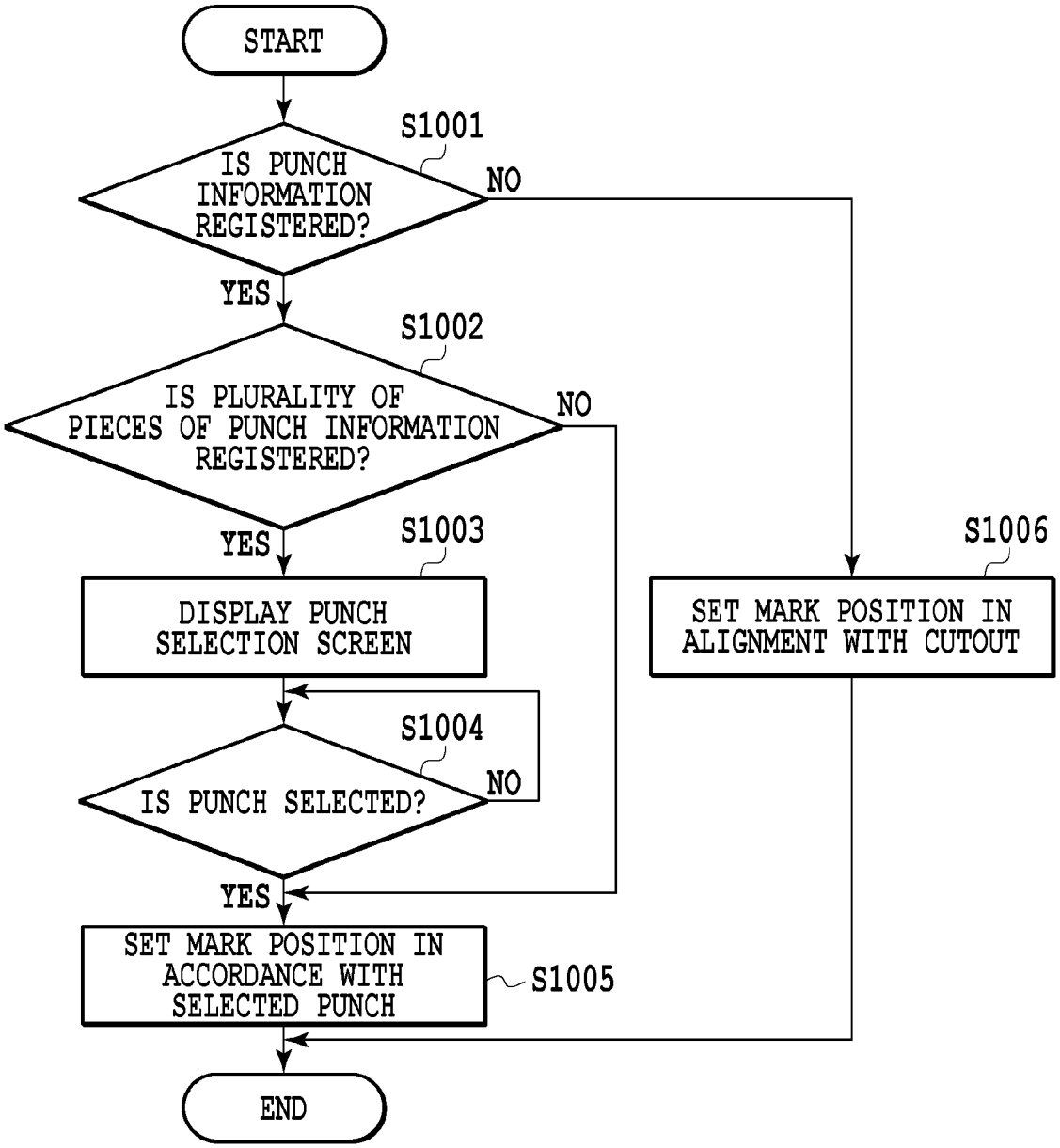
FIG. 10 is a flowchart showing a flow of mark position setting processing according to a second embodiment.

FIG. 10 is a flowchart showing a flow of mark position setting processing according to the present embodiment and the processing is performed prior to, for example, each piece of processing at steps 309 and 310 in the flowchart in the foregoing FIG. 3 in accordance with the necessity.

Figure 11:
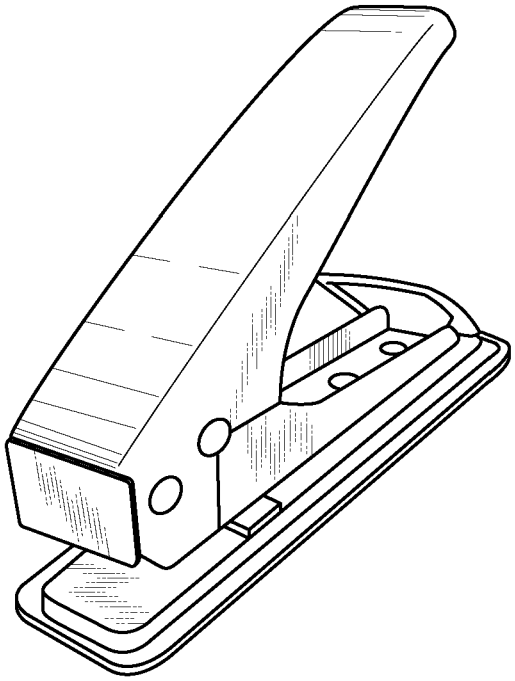
FIG. 11 is a diagram showing an example of a punch used at the time of forming a cutout in printed matter.
Figure 12A:
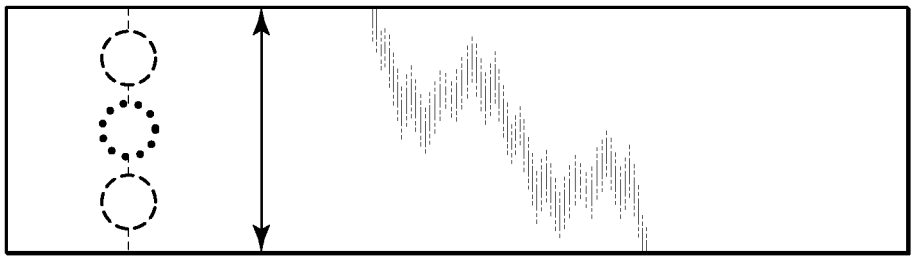
FIGS. 12A and 12B are each a plan view of a punch viewed from above.
Figure 12B:
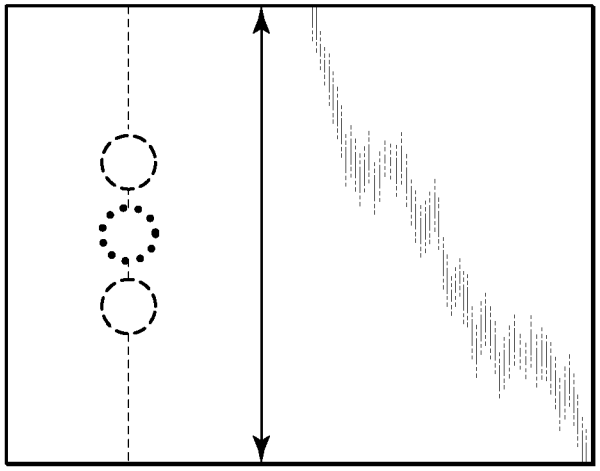

At step 1001, the control unit 204 determines whether punch information is registered. Here, punch information is explained. FIG. 11 is a diagram showing an example of a punch used for forming a cutout in printed matter. FIG. 12A is a plan view in the case where the punch in FIG. 11 is viewed from above, and a punch hole in the case where one cutout is formed and a punch hole in the case where two cutouts are formed are shown by different kinds of lines. FIG. 12B is a plan view in the case where a punch of different type is viewed from above. In punch information, for each punch of different type, the product name (product No.) and the size (in particular, width: length shown by a double-pointed arrow in FIGS. 12A and 12B) are made to correspond to each other. Punch information is registered in advance by a user inputting the product name and the size of a punch via the operation unit 202. The size of a punch is determined uniquely based on the product name of the punch, and therefore, it may also be possible to cause the control unit 204 to automatically acquire size information on the punch via the LAN 102 based on the product name of the punch input by a user. In the case where it is determined that such punch information is registered, the procedure proceeds to step 1002. On the other hand, in the case where it is determined that punch information is not registered, the procedure proceeds to step 1006.

At step 1002, the control unit 204 determines whether there is a plurality of pieces of registered punch information. In the case where it is determined that there is a plurality of pieces of registered punch information, the procedure proceeds to step 1003. On the other hand, in the case where it is determined that there is not a plurality of pieces of registered punch information (there is only one piece of registered punch information), the procedure proceeds to step 1005.

At step 1003, the control unit 204 displays a punch selection screen (not shown) on which to select one punch from among the plurality of pieces of registered punch information on the display unit 203 to prompt a user to select a punch.

At step 1004, the control unit 204 determines whether one punch is selected on the punch selection screen. This determination processing is repeated until one punch is selected by a user and in the stage where it is determined that one punch is selected, the procedure proceeds to step 1005.

At step 1005, the control unit 204 reads the only piece of punch information registered in advance (in the case of No at step 1002) or the punch information selected by a user (in the case of Yes at step 1002). Then, the control unit 204 sets a position of a mark based on the read punch information.

Figure 13A:
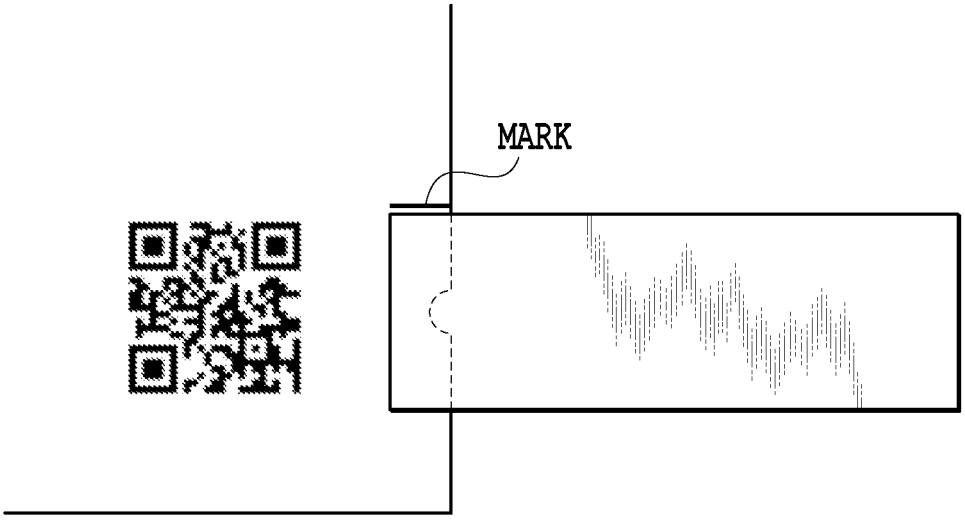
FIGS. 13A and 13B are diagrams each showing a mark position set in accordance with the punch.
Figure 13B:
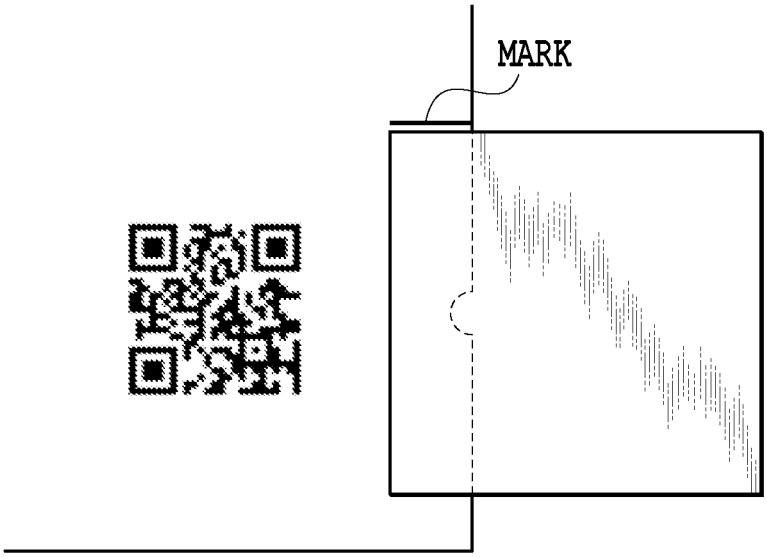

FIG. 13A is a diagram showing a position of a mark set in accordance with the punch of type shown in FIG. 12A and FIG. 13B is a diagram showing a mark position set in accordance with the punch of type shown in FIG. 12B. As is obvious from FIGS. 13A and 13B, it is known that the position of the mark differs depending on the size of the punch used in the present embodiment.

At step 1006, the control unit 204 performs settings so that the position of the mark is the position of the cutout as in the first embodiment.

The above is the contents of the mark position setting processing.

As explained above, according to the present embodiment, the position of the mark is determined in accordance with the type of the punch used actually by a user. Due to this, it is unlikely that the mark is hidden by the punch and it is possible for a user to form a cutout more accurately by positioning the punch in accordance with the printed mark.

Third Embodiment

Next, an aspect is explained as a third embodiment, in which a dummy code is attached to a blank page that may be produced in the case where booklet printing is set in the printing settings. The parts same as those in the other embodiments is simplified or omitted in the explanation and here, different points are explained mainly.

For example, in the case where a document including seven pages in total and to each page of which a code is attached is printed in booklet printing, printing is performed on output sheets so that printed matter 1401 in the form of a booklet is obtained finally (see page 14). At this time, the final page (eighth page) of the printed matter 1401 is a blank page and includes no data, and therefore, no code is attached.

However, for example, it is not possible for the visually impaired to recognize that the page is a blank page in this state, and therefore, the visually impaired is likely to make an attempt to read a code as in the case of another page to which a code is attached. As a result, no voice data is obtained from the blank page, however, it is difficult to determine whether the reason why no data is obtained is because reading a code fails or because the page is a blank page.

As in the present embodiment, by printing a code including voice data indicating that the page includes no printed contents on a blank page, it is possible to solve the above-mentioned problem.

Figure 15:
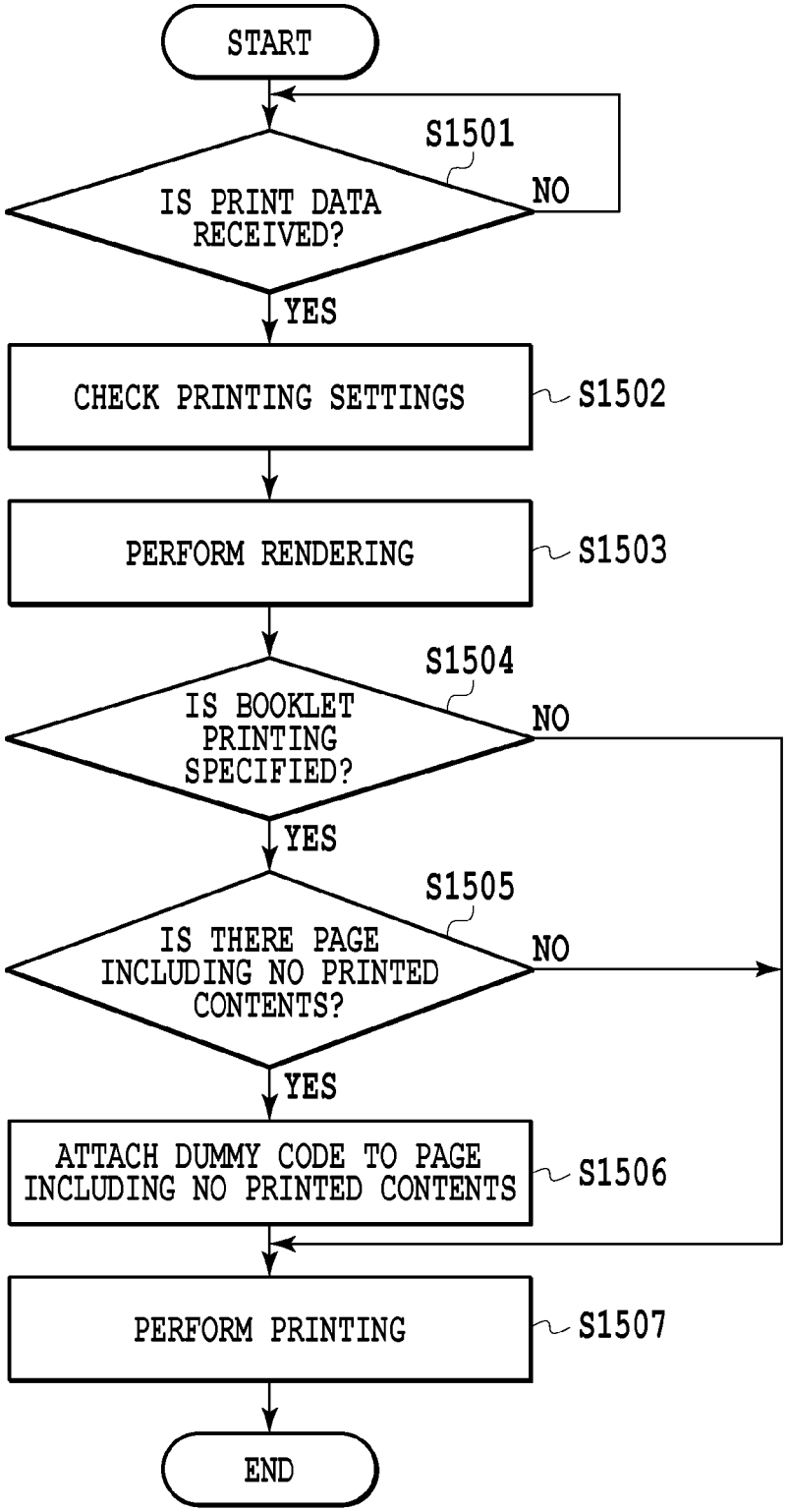
FIG. 15 is a flowchart showing a flow of printing processing in a third embodiment.

FIG. 15 is a flowchart showing a flow of printing processing in the present embodiment. The series of processing is performed by the CPU executing a computer executable program in which a procedure shown below is described after reading the program from the ROM onto the RAM.

Steps 1501 to 1503 correspond to the foregoing steps 301 to 303, respectively, and therefore, explanation is omitted here.

At step 1504, the control unit 204 determines whether booklet printing is specified in the printing settings checked at step 1502. In the case where it is determined that booklet printing is specified, the procedure proceeds to step 1504. On the other hand, in the case where it is determined that booklet printing is not specified, the procedure proceeds to step 1507.

At step 1505, the control unit 204 determines whether there is a page including no printed contents in the raster image data stored in the first specified area of the HDD. In the case where it is determined that there is a page including no printed contents, the procedure proceeds to step 1506. In the case where it is determined that there is not a page including no printed contents (i.e. all the pages include printed contents), the procedure proceeds to step 1507.

Figure 14:
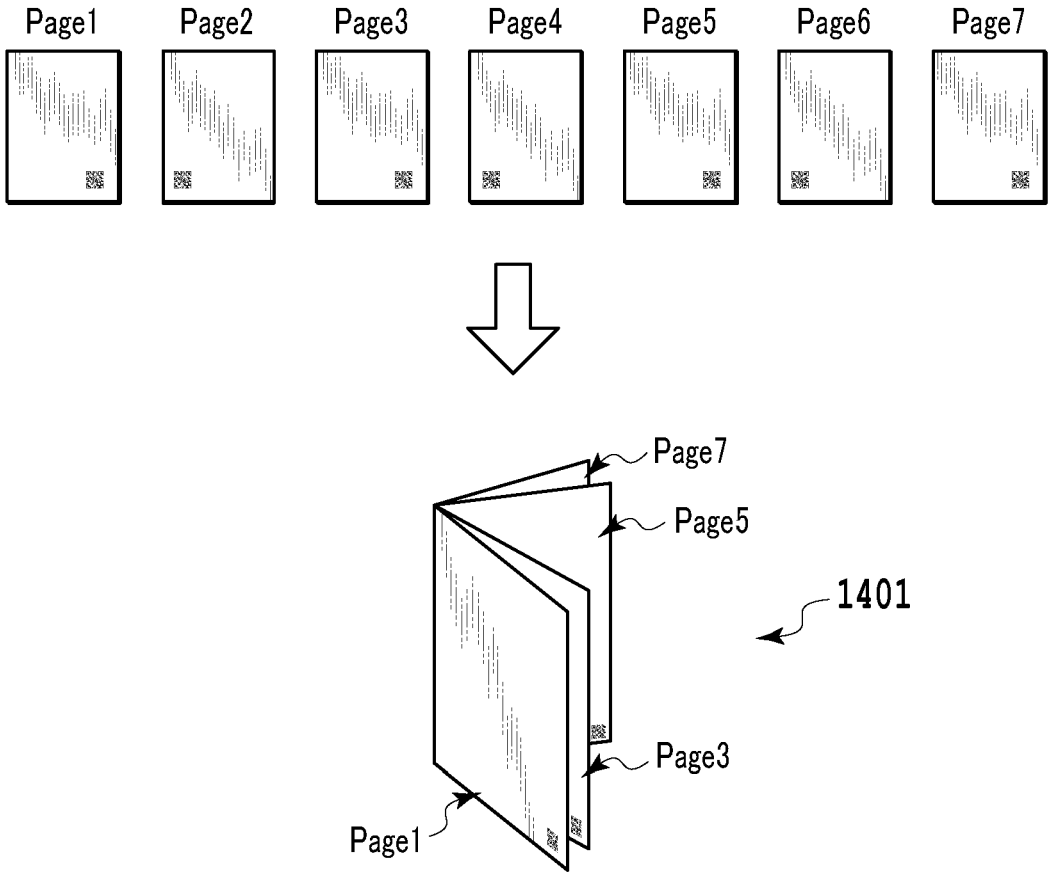
FIG. 14 is a diagram showing printed matter in the case where a document is printed in booklet printing.
Figure 16:
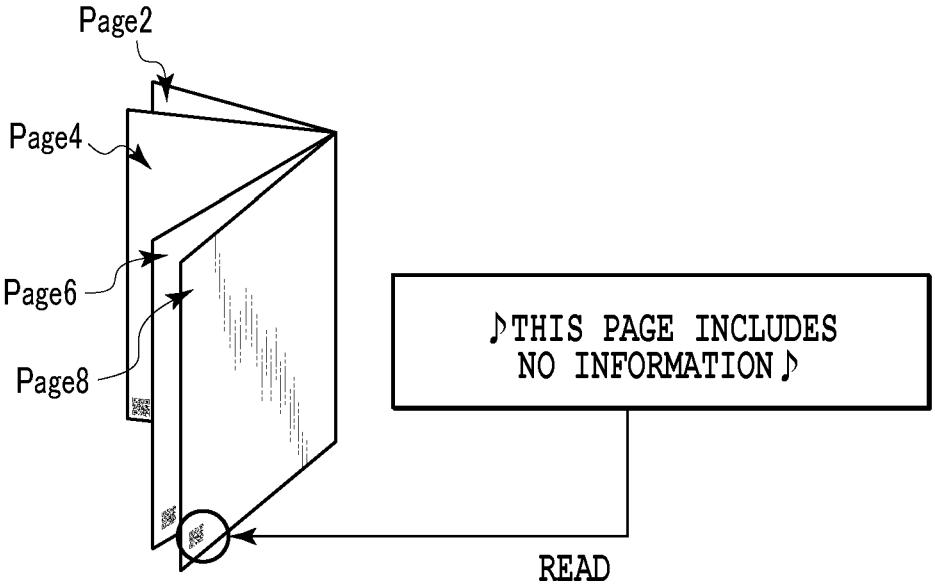
FIG. 16 is a diagram showing a state where a code including voice data indicative of a blank page is printed in the case where a document is printed in booklet printing.

At step 1506, the control unit 204 generates a code (for example, a voice code) including voice data indicating that the page is a blank page and generates raster image data in which the generated code is arranged in a predetermined position as data of a blank page. FIG. 16 is a diagram showing a state where a code including voice data ("This page includes no information") indicating that the page is a blank page is printed on the eighth page, which is a blank page, in the case where the document including seven pages in total is printed in booklet printing shown in FIG. 14.

At step 1507, the control unit 204 transfers the generated raster image data to the printer unit 206 and instructs the printer unit 206 to perform the printing operation in accordance with the printing settings.

As explained above, according to the present embodiment, to a blank page that may be produced in the case where booklet printing is set, a code including information indicating that the page is a blank page is attached. Due to this, it is possible for the visually impaired to correctly recognize the presence of a blank page.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment (s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-025816, filed Feb. 13, 2013, which is hereby incorporated by reference herein in its entirety.

What is claimed is:

1. An apparatus comprising:

a unit configured to determine a position of attachment of a code including voice information in an image; and an attaching unit configured to attach a mark in a position based on the determined position of code attachment in the image, wherein the mark indicates a position to be cut out from a sheet, on a side of which the image and the attached mark are to be printed and a cutout to be caused by cutting the position out indicates a position of code attachment.

2. The apparatus according to claim 1, further comprising a determination unit configured to determine whether a code including voice information is attached to the other side of the sheet, wherein the attaching unit is configured to attach more marks in a case where the determination unit determines that the code is attached to a back side than in a case where the determination unit determines that the code is not attached to the back side.

3. A method comprising the steps of:

determining a position of attachment of a code including voice information in an image; and attaching a mark in a position based on the determined position of code attachment in the image, wherein the mark indicates a position to be cut out from a sheet, on a side of which the image and the attached mark are to be printed and a cutout to be caused by cutting the position out indicates a position of code attachment.

4. The method according to claim 3, further comprising a step of determining whether a code including voice information is attached to the other side of the sheet, wherein in the attaching step, more marks are attached in a case where it is determined that the code is attached to a back side in the determining step than in a case where the determining step determines that the code is not attached to the back side.

5. An image forming apparatus capable of printing after attaching a code to a document image, the apparatus comprising:

a printing unit configured to perform printing after combining a mark with the document image in a case where voice data is included in the code, wherein the mark is a guide at the time of forming a cutout in a printed matter, the cutout indicating that a code including voice data exists in the printed matter.

6. The image forming apparatus according to claim 5, further comprising a determination unit configured to determine whether the code including voice data is included in a specific area of the document image.

7. The image forming apparatus according to claim 5, wherein a number of marks differs depending on whether the code including voice data is printed on both sides of a sheet to be output.

8. The image forming apparatus according to claim 5, wherein the code is a voice code.

9. The image forming apparatus according to claim 5, wherein the code is a QR code.

10. The image forming apparatus according to claim 5, wherein a position where the mark is printed is a position where the cutout should be formed.

11. The image forming apparatus according to claim 5, further comprising a unit configured to adjust the position where the mark is printed in accordance with a shape of a tool used for forming the cutout.

12. The image forming apparatus according to claim 11, further comprising:

a registration unit configured to register information of the tool; and a reception unit configured to receive a selection of the tool to be used from a user in a case where information of a plurality of tools is registered in the registration unit.

* * * * *